US009885212B2

(12) United States Patent
Swinford

(10) Patent No.: US 9,885,212 B2
(45) Date of Patent: Feb. 6, 2018

(54) DOWNHOLE OSCILLATOR

(75) Inventor: Jerry L. Swinford, Spring, TX (US)

(73) Assignee: Coil Tubing Technology, Inc., Spring, TX (US)

( * ) Notice: Subject to any disclaimer, the term of this patent is extended or adjusted under 35 U.S.C. 154(b) by 1098 days.

(21) Appl. No.: 13/434,812

(22) Filed: Mar. 29, 2012

(65) Prior Publication Data

US 2012/0247757 A1 Oct. 4, 2012

Related U.S. Application Data

(60) Provisional application No. 61/468,637, filed on Mar. 29, 2011.

(51) Int. Cl.
*E21B 7/24* (2006.01)
*E21B 4/14* (2006.01)
*E21B 4/10* (2006.01)

(52) U.S. Cl.
CPC . *E21B 4/14* (2013.01); *E21B 4/10* (2013.01)

(58) Field of Classification Search
USPC ..... 415/202, 903, 904; 166/249, 177.1, 166/177.2, 177.6; 175/55, 56, 107, 386
See application file for complete search history.

(56) References Cited

U.S. PATENT DOCUMENTS 1,727,276 A 9/1929 Diehl et al.
1,860,214 A 5/1932 Yeaman et al.
1,962,308 A * 6/1934 Jacobson ..... 239/236
2,944,792 A 7/1960 Gros
3,049,185 A * 8/1962 Herbold ..... E21B 7/206 166/233
3,133,603 A 5/1964 Lagacherie et al.
3,162,426 A * 12/1964 Fontaine ..... 366/120
3,416,732 A * 12/1968 Reiter ..... 239/227
3,419,091 A * 12/1968 Gardner ..... 175/67
3,844,362 A 10/1974 Elbert et al.
4,058,163 A * 11/1977 Yandell ..... 166/177.6
4,259,111 A * 3/1981 Kadau ..... B23K 35/304 420/442
4,397,619 A * 8/1983 Alliquander et al. ..... 418/48
4,440,242 A 4/1984 Schmidt et al.
4,529,046 A 7/1985 Schmidt et al.
(Continued)

*Primary Examiner* — Giovanna C. Wright
*Assistant Examiner* — Ronald R Runyan
(74) *Attorney, Agent, or Firm* — Martinez Law Group PLLC; Melissa M. Martinez

(57) ABSTRACT

An exemplary embodiment of the downhole oscillator includes an outer housing at least partially surrounding a motor and a removably coupled eccentric member. The motor at least partially drives the rotation of the eccentric member thereby producing oscillations or vibrations along the outer diameter of at least a portion of the downhole assembly. The motor's action is at least partly facilitated by expulsion of fluid from the drill string through the motor and onto the outer housing interior such that the force of the fluid produces rotation in the motor. Rotation may be enhanced through similar expulsion of fluid from the eccentric member. Alternatively, the fluid may be expelled from the motor and/or eccentric member against the wellbore thereby providing the desired rotation. A method of use may include providing an outer housing, motor capable of producing rotational movement, and eccentric member and coupling same.

18 Claims, 12 Drawing Sheets

(56) References Cited

U.S. PATENT DOCUMENTS

| | | | | |
|---|---|---|---|---|
| 4,693,325 | A | 9/1987 | Bodine | |
| 5,052,503 | A * | 10/1991 | Lof | 175/258 |
| 5,101,916 | A | 4/1992 | Lesh | |
| 5,186,265 | A * | 2/1993 | Henson et al. | 175/107 |
| 5,210,381 | A * | 5/1993 | Brett | 181/106 |
| 5,385,407 | A | 1/1995 | De Lucia | |
| 5,518,379 | A | 5/1996 | Harris et al. | |
| 5,803,187 | A | 9/1998 | Javins | |
| 5,833,444 | A | 11/1998 | Harris et al. | |
| 6,520,271 | B1 | 2/2003 | Martini | |
| 6,527,513 | B1 | 3/2003 | Van Drentham-Susman et al. | |
| 7,686,102 | B2 | 3/2010 | Swinford | |
| 7,703,551 | B2 | 4/2010 | Reagan | |
| 8,151,908 | B2 | 4/2012 | Swinford | |
| 2007/0227779 | A1* | 10/2007 | Swinford | E21B 4/02 175/71 |
| 2009/0173542 | A1 | 7/2009 | Ibrahim et al. | |
| 2010/0078219 | A1 | 4/2010 | Swinford | |
| 2010/0224412 | A1 | 9/2010 | Allahar | |
| 2010/0276198 | A1 | 11/2010 | Light | |

* cited by examiner

DOWNHOLE OSCILLATOR

CROSS-REFERENCE TO RELATED APPLICATIONS

This application claims the benefit of U.S. provisional application Ser. No. 61/468,637 filed on Mar. 29, 2011, which is incorporated herein by reference as if reproduced in full below.

STATEMENT REGARDING FEDERALLY SPONSORED RESEARCH OR DEVELOPMENT

Not Applicable.

FIELD OF THE DISCLOSURE

The disclosure relates, in general, to a downhole drilling apparatus. More specifically, the invention is directed to a downhole oscillator providing vibration or oscillation along at least a portion of the bottom hole assembly.

BACKGROUND

Those in the oil and gas field attempt to reduce harmful vibrations that occur during drilling operations. However, in some cases, the providing of purposeful oscillation or vibration to a bottom hole assembly is desired as it will work to reduce friction and improve the string to bit weight transfer. High friction can lead to high well tortuosity thereby limiting step-out and possibly negatively affecting productivity. By providing purposeful oscillation or vibration one can reduce drag thereby improving weight transfer to the bit. Further, tool face control may be improved by minimizing static friction.

This provision of oscillation or vibration may work to beneficially increase the penetration rate, extend drill bit life through the improved weight transfer and reduction of impact forces, and/or reducing the amount of drill pipe compression that would be required otherwise. Oscillation can be beneficial in any type of drilling operations, including, but not limited to, directional or horizontal drilling, and other applications such as fishing and milling.

BRIEF SUMMARY OF THE DISCLOSURE

A downhole oscillator having an eccentric member is provided that creates oscillation of at least a part of the bottom hole assembly. An exemplary embodiment of the downhole oscillator includes an outer housing at least partially surrounding a motor and a functionally coupled eccentric member. The motor at least partially drives the rotation of the asymmetrical eccentric member thereby producing oscillations or vibrations along at least a portion of the downhole assembly. The motor's action is at least in part facilitated by expulsion of fluid from the drill string through the motor and onto the interior of the outer housing such that the force of the interaction between the motor and outer housing produces rotation in the motor. This rotation may be enhanced through expulsion of fluid from the eccentric member whereby the interaction of the expelled fluid therefrom interacts with the interior of the outer housing thereby providing rotation of the eccentric member. Different sized and weighted eccentric members may be utilized to produce the desired oscillating effect.

Alternatively, the fluid may be expelled from the motor and/or the eccentric member against the interior of the wellbore thereby providing the desired rotation.

A method of use may include providing an outer housing, a motor capable of producing rotational movement, and an asymmetrical eccentric member and functionally coupling same. Connecting the foregoing to a drill string. Activating the motor to produce vibration in at least a portion of the drill string.

Other features and advantages of the invention will be apparent from the following description, the accompanying drawings and the appended claims.

DETAILED DESCRIPTION OF EXEMPLARY EMBODIMENTS

Figure 1:
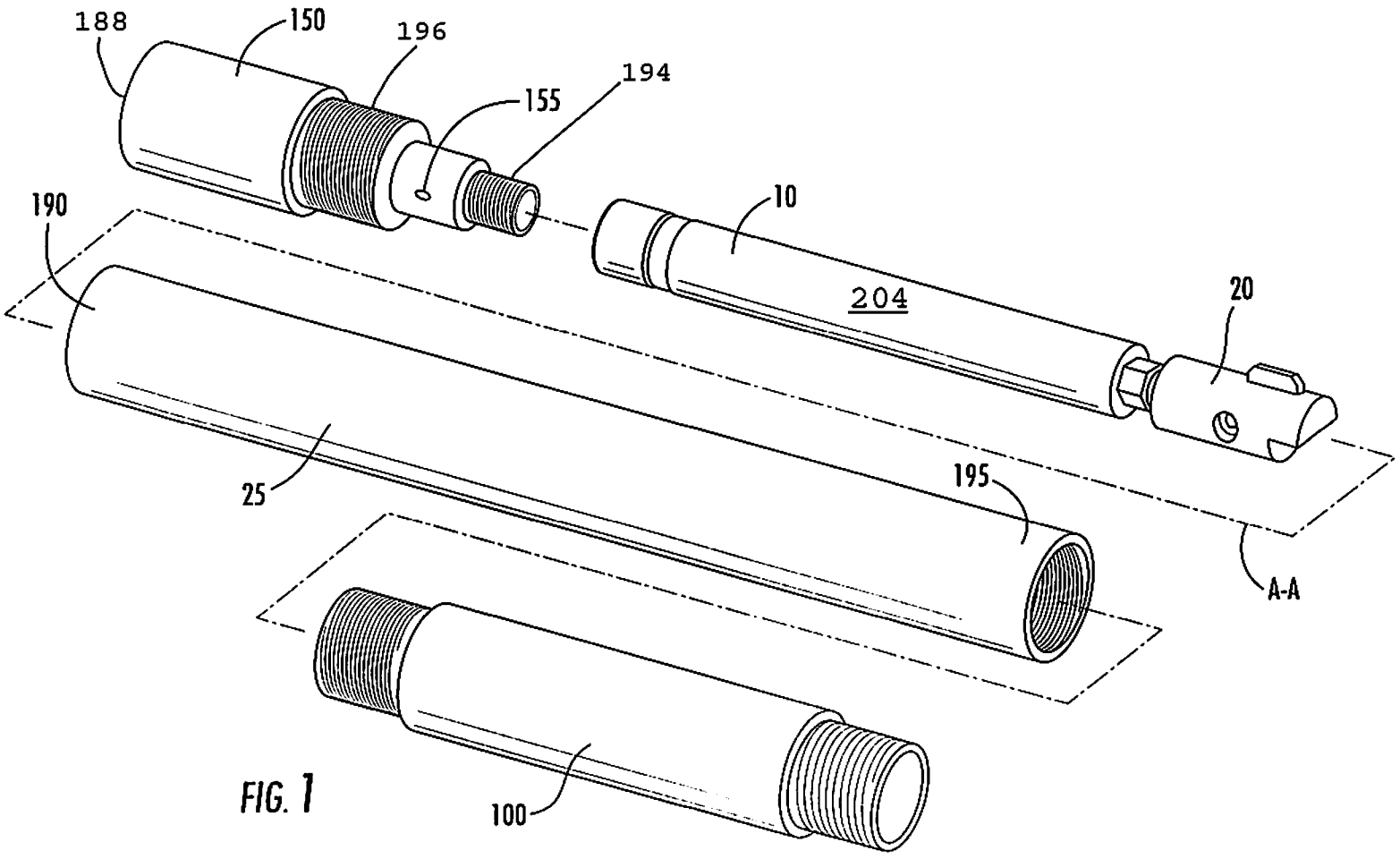
FIG. 1 is a partially exploded view of an exemplary embodiment of the downhole oscillator.
Figure 2:
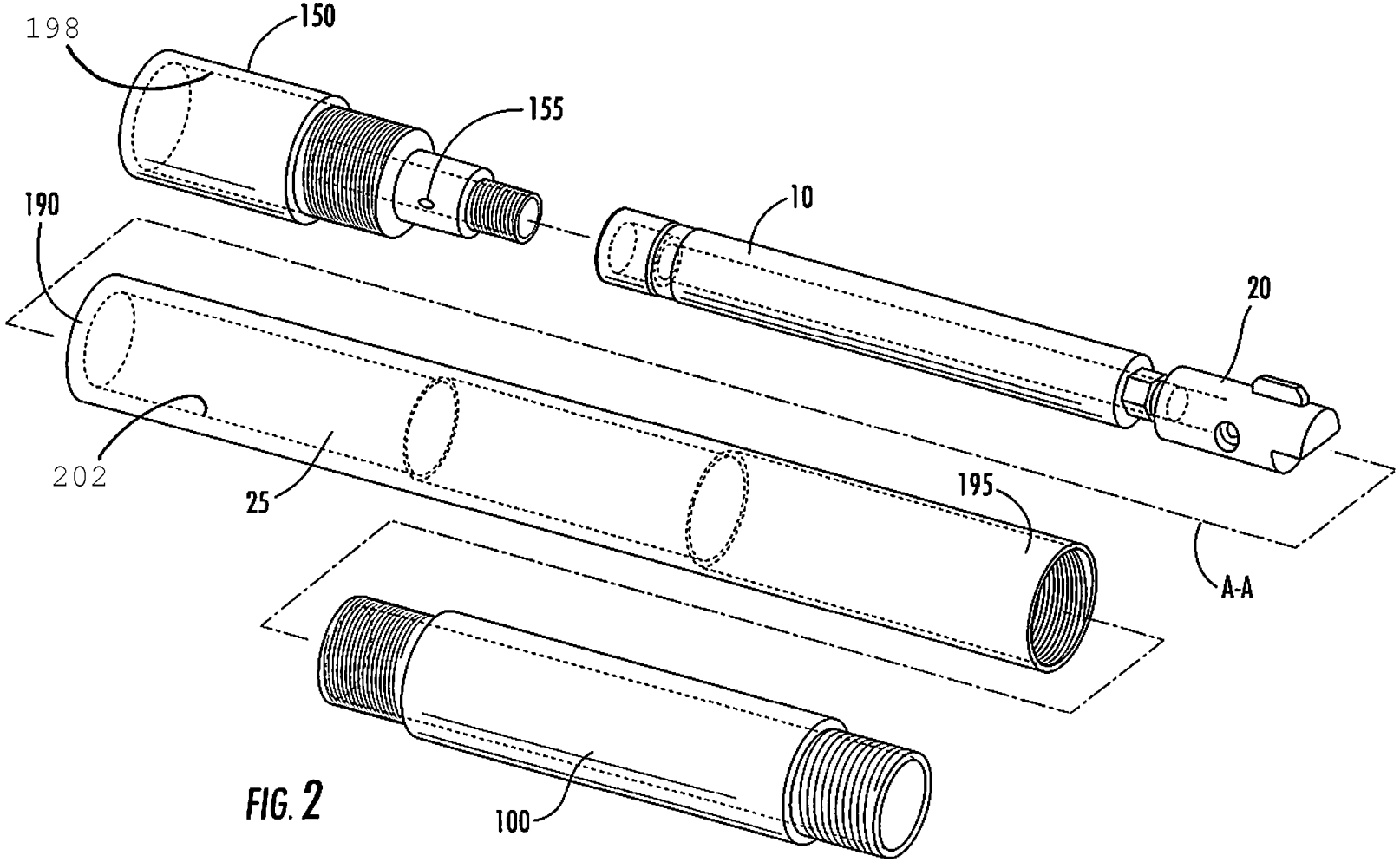
FIG. 2 is a partially exploded view of an exemplary embodiment of the downhole oscillator showing select channels therein.

Referring to FIGS. 1 and 2, an exemplary embodiment of a downhole oscillator 5 is shown which generally comprises a motor 10, an eccentric member 20, and an outer housing 25.

As used herein, the term "upper" will refer to the direction of the top sub 150 that connects to a drill string or tubing (not shown). As used herein, the term "lower" will refer to the direction of the lower sub 100. However, it will be understood that these terms are simply for ease of reference and have no bearing on the actual use of the invention.

A cylindrical, elongated outer housing 25 at least partially surrounds the motor 10. The outer housing 25 may be used to connect the motor 10, and its functionally coupled eccentric member 20, to a drill string (not shown). The outer housing 25 may also at least partially surround the eccentric member 20.

The outer housing 25 is functionally connectable at its string connection end 190 to a drill string, though the connection may not be direct. For example, in the exemplary embodiment shown, the outer housing 25 is connected to a top sub 150 at its string connection end 190. The top sub 150 may then be functionally coupled to the drill string or tubing and a fluid source (not shown).

In the exemplary embodiment shown, the top sub 150 is generally cylindrical with a fluid passage 198 extending therethrough. Fluid passage 198 is generally aligned with axis A-A. The top sub 150 has an upper drill string connection end 188, a lower motor connection end 194, and a lower housing connection end 196. The connection ends 188, 194, 196 may employ any known or later discovered method of connection, including, but not limited to, threaded connections. The top sub 150 contains at least one dump port 155 proximate the downhole oscillator 5. The dump ports 155 may be disposed intermediate the lower motor connection end 194 and the lower housing connection end 196 of the top sub 150. The dump ports 155 are in fluid communication with the fluid passage 198 of the top sub 150, and thereby are in fluid communication with the fluid source.

Figure 3:
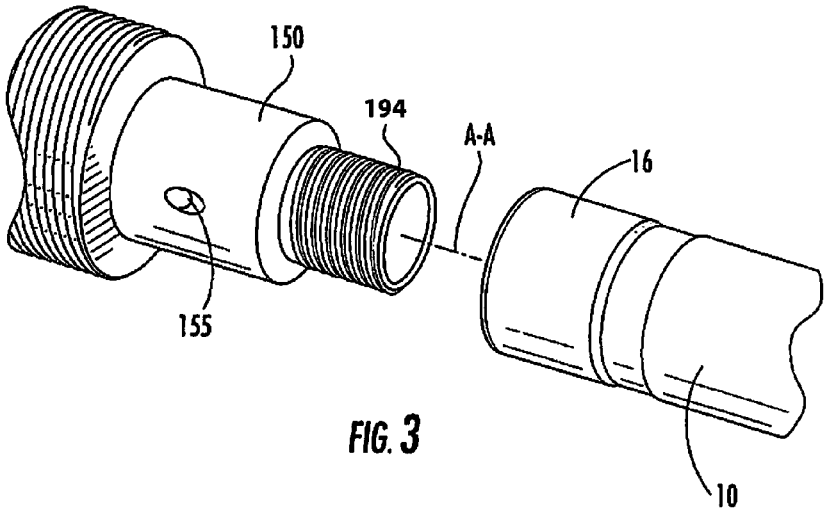
FIG. 3 is a perspective view of the motor and top sub.

Referring to FIG. 3, top sub 150 connects to jet motor 10 via lower motor connection end 194. Jet motor 10 is rotably disposed within outer housing 25. The outer housing 25 connects to the top sub 150 at its connection end 190. When connected, at least a portion, if not all, of the dump ports 155 are disposed within the housing 25. Further, at least a portion, if not all, of the motor 10 is disposed within the housing 25. The motor 10 is functionally coupled to the top sub 150 thereby allowing at least some of the fluid, which may be pressurized as needed, to flow from the top sub 150 and into the motor 10.

In operation, fluid, having a desired pressure, is pumped to the downhole oscillator 5. When the lower motor connection end 194 of the top sub 150 is functionally connected to the motor 10, some of the fluid that will pass through the fluid passage 198 of the top sub 150 will enter into the motor 10 therefrom. This fluid will power the motor 10 thereby producing the oscillations or vibrations. A housing annulus 200 is defined as the space between the interior surface 202 of the housing 25 and the exterior surface 204 of the motor 10 when the housing 25 and motor 10 are functionally coupled. At least some of the fluid will flow into the housing annulus 200 through the dump ports 155, thereby bypassing the interior of the motor 10 on its way towards the bottom hole assembly.

The outer housing 25 is functionally connectable, either directly or indirectly, at its lower connection end 195 to a drill bit, bottom hole assembly, or other downhole component. This connection may be facilitated through the use of a lower sub 100 to connect the downhole oscillator 5 to the desired downhole component (not shown). Through direct connection of the outer housing 25 to the bottom hole assembly, and/or other downhole component, with or without the use of a lower sub 100, the eccentric member 20 may be functionally coupled to the drill string while being allowed freedom of movement in order to effect the desired oscillation or vibration of same.

Figure 4:
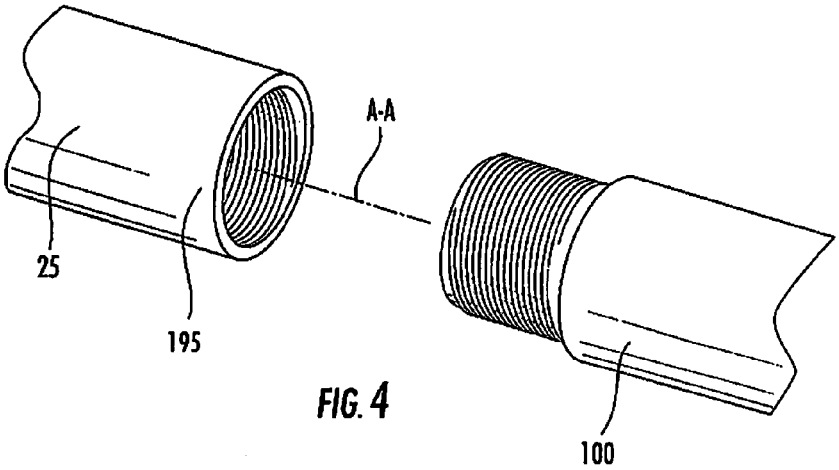
FIG. 4 is a perspective view of the housing and the lower sub.

Referring to FIG. 4, outer housing 25 lower connection end 195 may be connected directly to lower sub 100.

Figure 5:
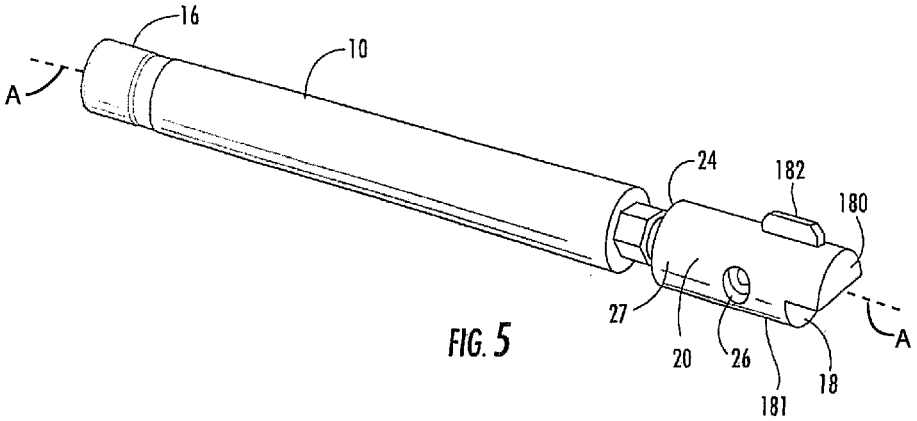
FIG. 5 is a perspective view of an exemplary embodiment of a fully assembled jet motor with an exemplary eccentric member attached thereto.
Figure 5A:
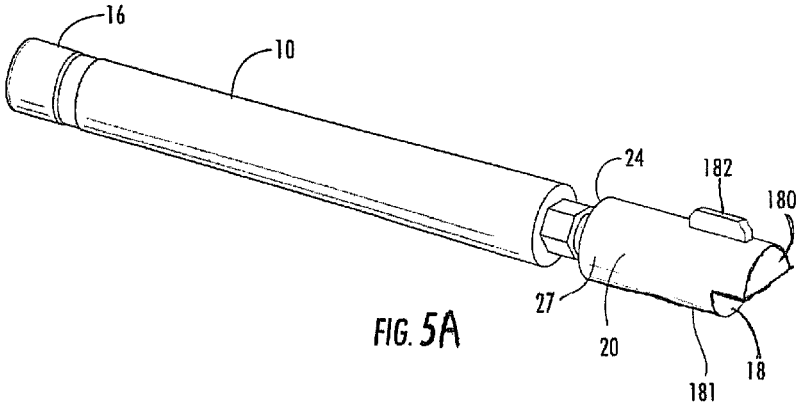
FIG. 5A is a perspective view of an alternative embodiment of the eccentric member.
Figure 5B:
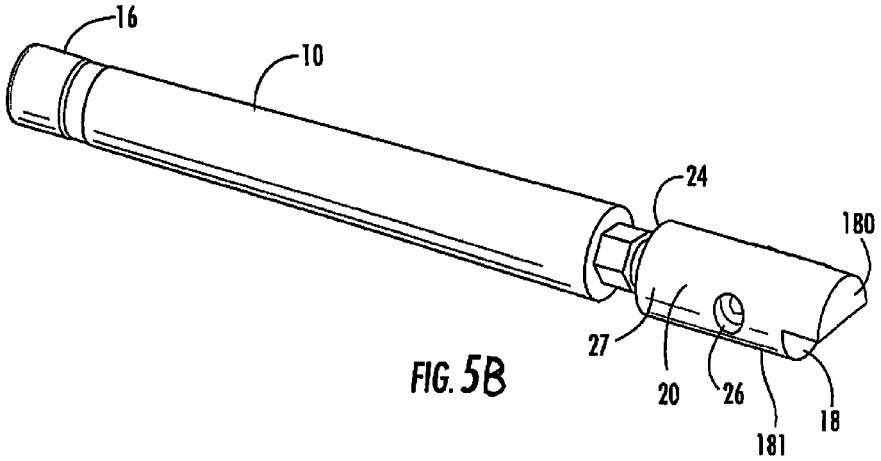
FIG. 5B is a perspective view of an alternative embodiment of the eccentric member.
Figure 6:
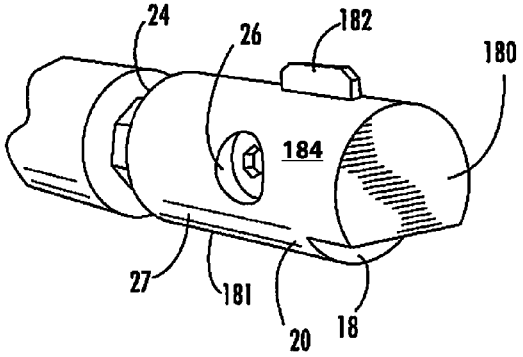
FIG. 6 is a perspective view of an alternative embodiment of the eccentric member.
Figure 6A:
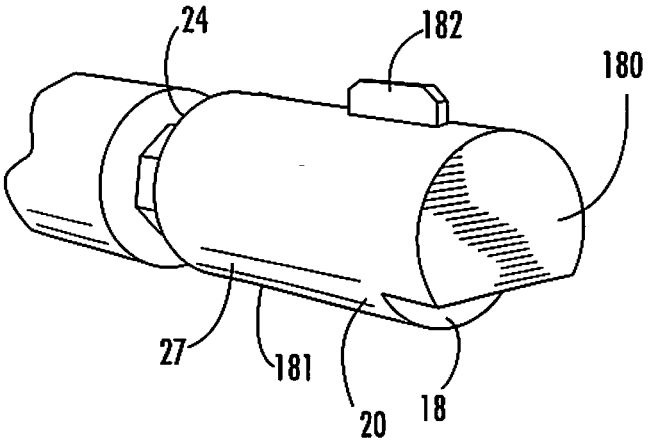
FIG. 6A is a perspective view of an alternative embodiment of the eccentric member.
Figure 6B:
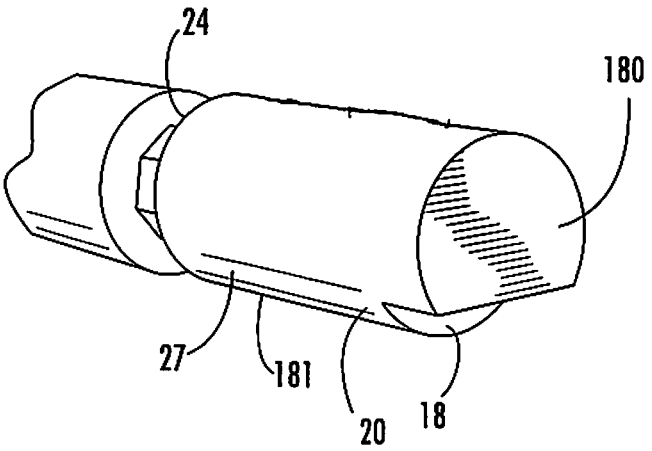
FIG. 6B is a perspective view of an alternative embodiment of the eccentric member.

Referring to FIGS. 5B and 6B, the eccentric member 20 of the exemplary embodiment is a generally asymmetrical member with a closed end 18 and an open connection end 24. The eccentric member 20 is asymmetrical in that at least a portion of the eccentric member 20 has a larger surface area 181 than another portion of the eccentric member 180 extending axially therefrom thereby resulting in greater weight along the enlarged portion 180 of the eccentric member 20 in relation to the remaining portion 181. The eccentric member 20 of the depicted exemplary embodiment is generally cylindrical; however, any shaped eccentric member 20 may be used wherein the shape and size of the eccentric member 20 varies from that shown in the exemplary embodiment herein so long as same fulfills the purpose of providing an eccentric member 20 with uneven weight distribution in order to produce vibration and/or oscillation in the downhole tool while in operation.

In an alternative embodiment shown in FIGS. 5, 5A, and 6, the enlarged portion 180 of the eccentric member 20 further contains a protrusion 182 extending therefrom. The protrusion 182 aids to add more weight to the enlarged portion 180 in order to further offset the eccentric member 20. Additional or varying sized and/or weighted members 180, 182 may be utilized to produce the desired frequency of vibration when in operation. In operation, the eccentric members 20 may be changed out or reconfigured in order to produce the desired result. In an alternative embodiment, the protrusion 182 is weighted as needed to produce the desired oscillation/vibration. Further, multiple eccentric members 20 having varying protrusion 182 and enlarged portion 180 sizes and weights may be provided.

Figure 7:
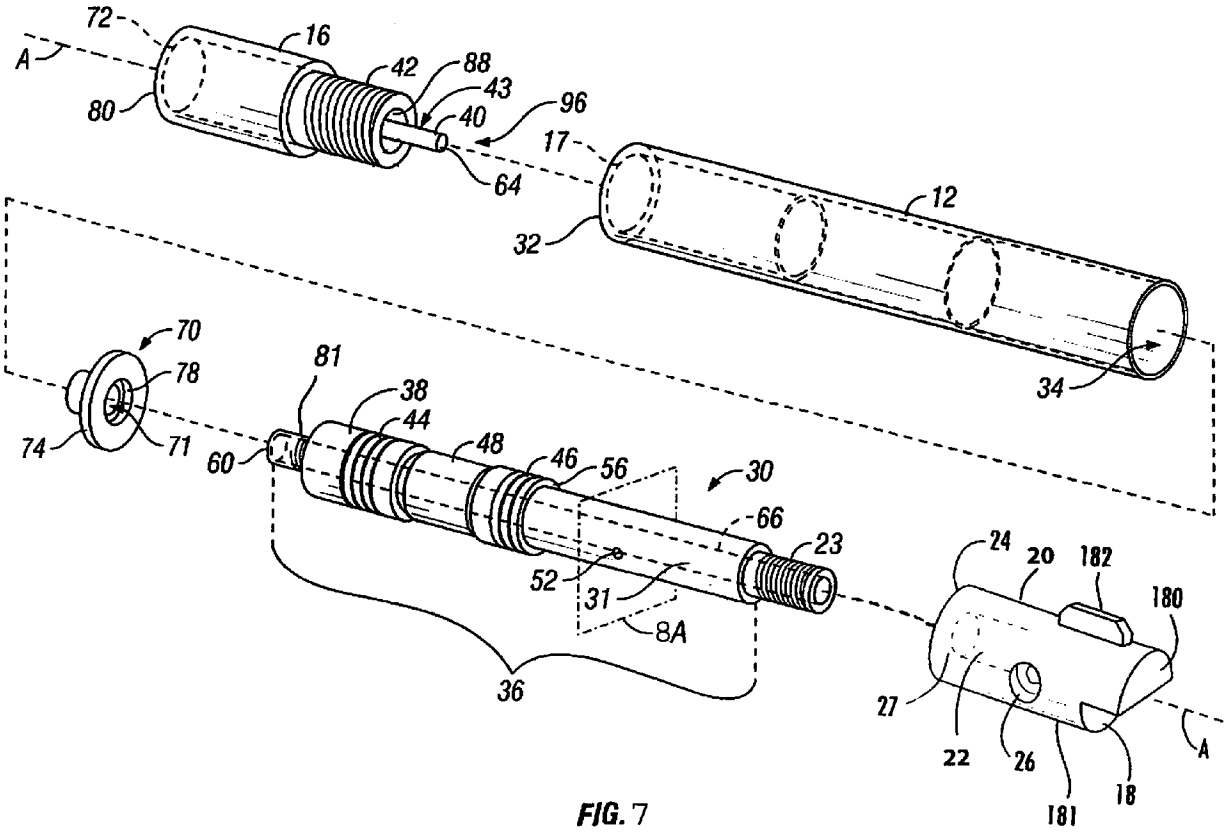
FIG. 7 is a partial exploded view of an exemplary embodiment of the motor of FIG. 5.

Referring to FIGS. 5 and 7, a channel 22 extends inwardly of the eccentric member 20 from its connection end 24. In an exemplary embodiment, threading is provided on the interior surface of the eccentric member 20 proximate the connection end 24 for threaded connection to the threaded lower connector 23 of the power shaft assembly 36. Threaded connection of eccentric member 20 and power shaft assembly 36 allows for eccentric member 20 to be removed and replaced with another eccentric member 20 of another size and weight to produce the desired oscillation and vibration. While a threaded connection is shown, it is understood that any type of functional coupling may be employed to affect the stated purpose.

In the exemplary embodiment shown in FIGS. 5, 5B, and 6, one or more rotation nozzles 26 are disposed in the cylinder wall 27 of the eccentric member 20. In an exemplary embodiment depicted in FIGS. 9A and 9B, at least two rotation nozzles 26 are provided. Rotation nozzles 26 are in fluid communication with the interior channel 22 of the eccentric member 20 which in turn is in fluid communication with the fluid source. The rotation nozzles 26 extend from the interior channel 22 out to the exterior surface 184 of the eccentric member 20. This coupling allows fluid to flow from the channel 22 to the exterior of the eccentric member 20. In the exemplary embodiment shown, fluid enters the channel 22 of the eccentric member 20 from the interior of the motor 10, which in turn enters the motor 10 from the drill string.

Figure 9A:
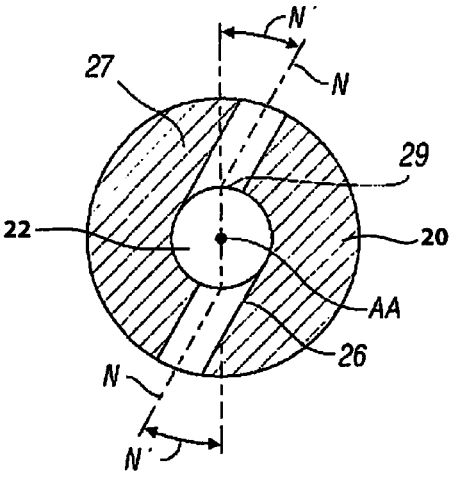
FIG. 9A is a cross-sectional view of an exemplary embodiment of the eccentric member taken along line 9A-9A in FIG. 10.

Referring to FIG. 9A, an exemplary embodiment of the nozzles 26 of the eccentric member 20 each have an axis N extending therethrough. Axis N extends radially with respect to the longitudinally extending axis AA, as shown in FIGS. 5 and 7, to allow radial fluid expulsion from the nozzle 26. This fluid expulsion from the nozzles 26 may strike the interior 202 of the outer housing 25 thereby providing rotational thrust in a desired direction.

Alternatively, at least one rotation nozzle 26 may extend radially in an oblique or aslant manner, axis N', thereby expelling fluid, when in operation, at an angle against a surface that is proximate thereto. The angling of the rotation nozzle 26, and the interaction of the expelled fluid therefrom with a proximate surface thereto, will generate rotation of the eccentric member 20. Examples of surfaces that are proximate the rotation nozzle 26 are the interior surface 202 of the housing 25, the interior surface 34 of the control sleeve 12, and the interior of the wellbore (not shown).

Described another way, the radially extending angle N' of the rotation nozzles 26 may be angled with respect to a plane passing parallel to and along the longitudinal axis AA at the interior opening 29, at the cylinder wall 27, of the nozzle 26. Wherein the angle N' is acute in relation to the plane. In an exemplary embodiment, the plane intersects the nozzle axis N at the interior opening 29.

Figure 9B:
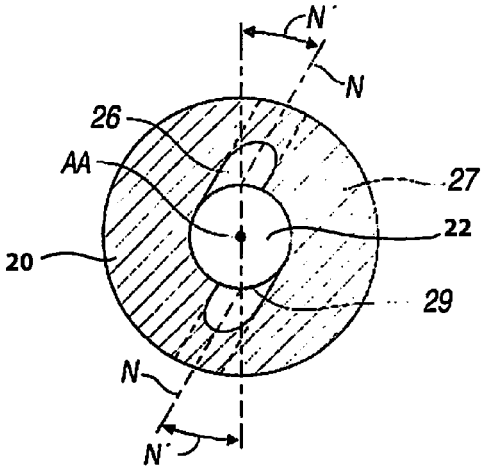
FIG. 9B is a cross-sectional view of an alternative embodiment of the eccentric member.

Referring to FIG. 9B, in an alternative embodiment, one or more rotation nozzles 26 may extend with their axis N oriented, at least partially, back toward the connecting end 24 of the eccentric member 20.

Described another way, one or more rotation nozzles 26 may extend angularly with respect to a plane passing perpendicular to the longitudinal extension of axis AA. In other words, the angle N of the nozzles 26 may extend along the axis AA wherein the angle is acute in the direction of the eccentric member's 20 connecting end 24 and obtuse with respect to the direction of its closed end 18. Alternatively, the nozzles 26 may be oriented in the reverse, wherein the angle N is acute in the direction of the closed end 18 of the eccentric member 20 and obtuse with respect to its open connecting end 24.

Referring to FIGS. 6A and 6B, in an alternative embodiment, the eccentric member 20 does not have rotation nozzles 26 nor a channel 22 and the rotation of the eccentric member 20 is driven solely by the motor 10. In this embodiment, the connecting end 24 simply connects the eccentric member 20 to the motor 10 in order to provide the necessary rotation.

A motor 10 is provided for functional coupling with the eccentric member 20. The motor 10 serves as a conduit for the pressurized fluid to the rotation nozzles 26 of the eccentric member 20 when the eccentric member 20 is the force pushing the rotation of the member 20. The motor 10 may also serve as the sole or additional driving force of the eccentric member 20.

Referring to FIG. 5, the exterior of the depicted exemplary embodiment of the motor 10 generally comprises a control sleeve 12 and upper subassembly 16 having a common central longitudinal axis AA.

Referring to FIGS. 5 and 7, the control sleeve 12 is generally composed of an elongated cylindrical barrel body, with a control sleeve channel 17 passing therethrough. The control sleeve channel 17 is oriented along axis AA. The control sleeve 12 is provided with a connecting assembly 19 at its upper end 32 for functional connection to the lower end 42 of the upper subassembly 16. This functional connection may be a threaded connection as shown or any other known or later discovered attachment method. The upper subassembly 16 is provided with a connecting assembly 82 at its end 80 to allow connection to a drill string or tubing (not shown), directly or indirectly. As shown in FIG. 3, in an exemplary embodiment, upper subassembly 16 is connectable to top sub 150 lower motor connection end 194. Threaded connections, as depicted, are commonly practiced. Accordingly, the control sleeve 12, after installation on a drill string or tubing, is in a fixed position in relation to the drill string or tubing.

The power shaft assembly 36 includes the power shaft 30, a lower radial bearing 46, a thrust bushing 48, an upper radial bearing 44, a retainer 38 and an upper thrust bushing 70.

The power shaft 30 comprises a hollow cylindrical structure having an internal channel 66 aligned with axis AA. The internal channel 66 allows fluid communication from a drill string or tube (not shown) to the channel 22 of the eccentric member 20.

The power shaft 30 is constructed and sized to rotate within the control sleeve 12 with the lower radial bearing 46 and upper radial bearing 44 providing radial support. As the eccentric member 20 is fixedly attached to the power shaft 30, the power shaft 30 at least partially drives the rotation of the eccentric member 20 thereby causing rotation of the power shaft 30 and the eccentric member 20 together in relation to the control sleeve 12 and the outer housing 25. In an alternative embodiment, eccentric member 20 contains at least one rotation nozzle 26, thereby providing at least a portion of the driving power. The power shaft 30 is at least partially surrounded by the control sleeve 12.

The thrust bushing 48 extends intermediate the lower radial bearing 46 and the upper radial bearing 44.

Figure 10:
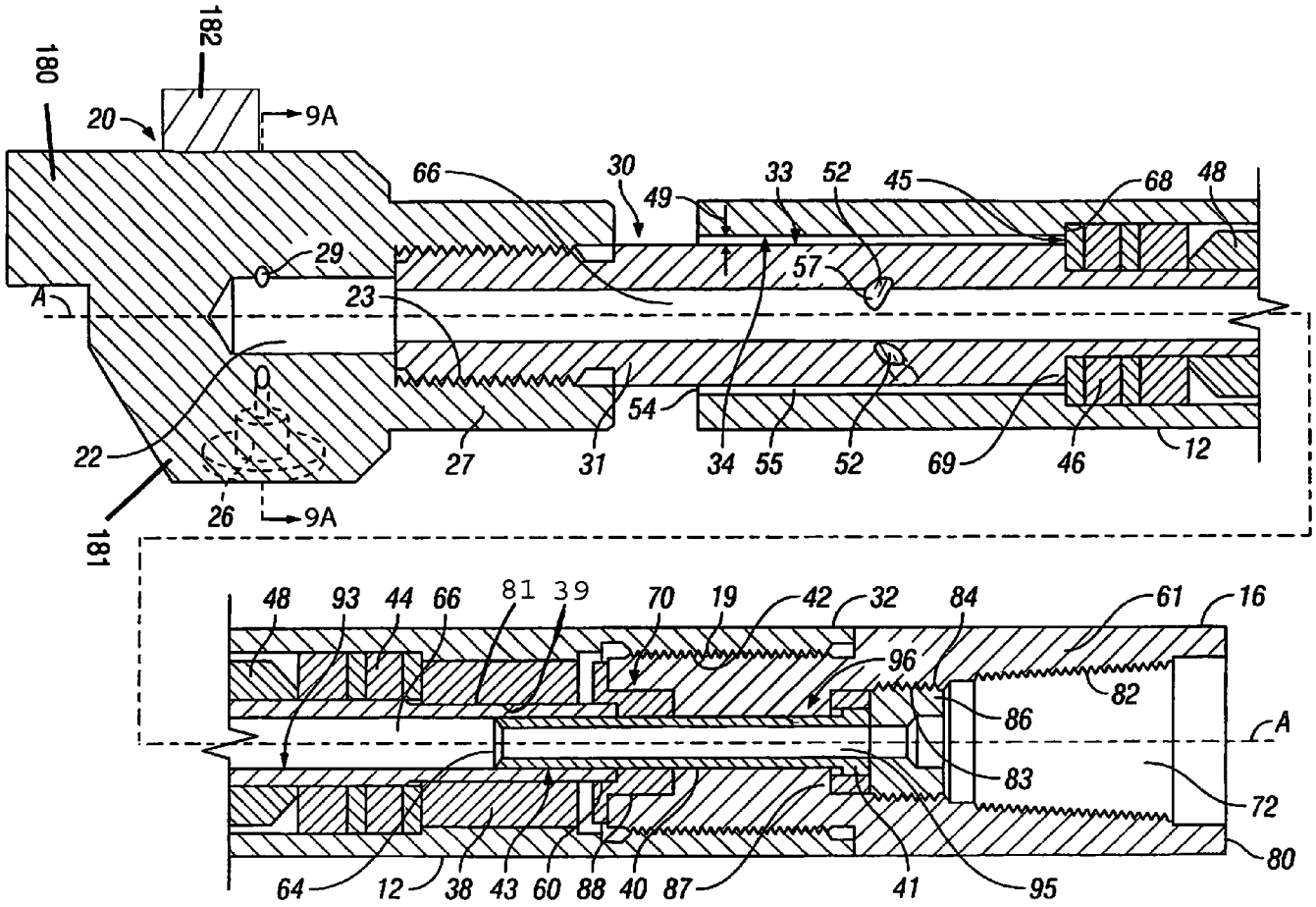
FIG. 10 is a cross-sectional view of an exemplary embodiment of the motor taken along axis A-A of FIG. 5.
Figure 11:
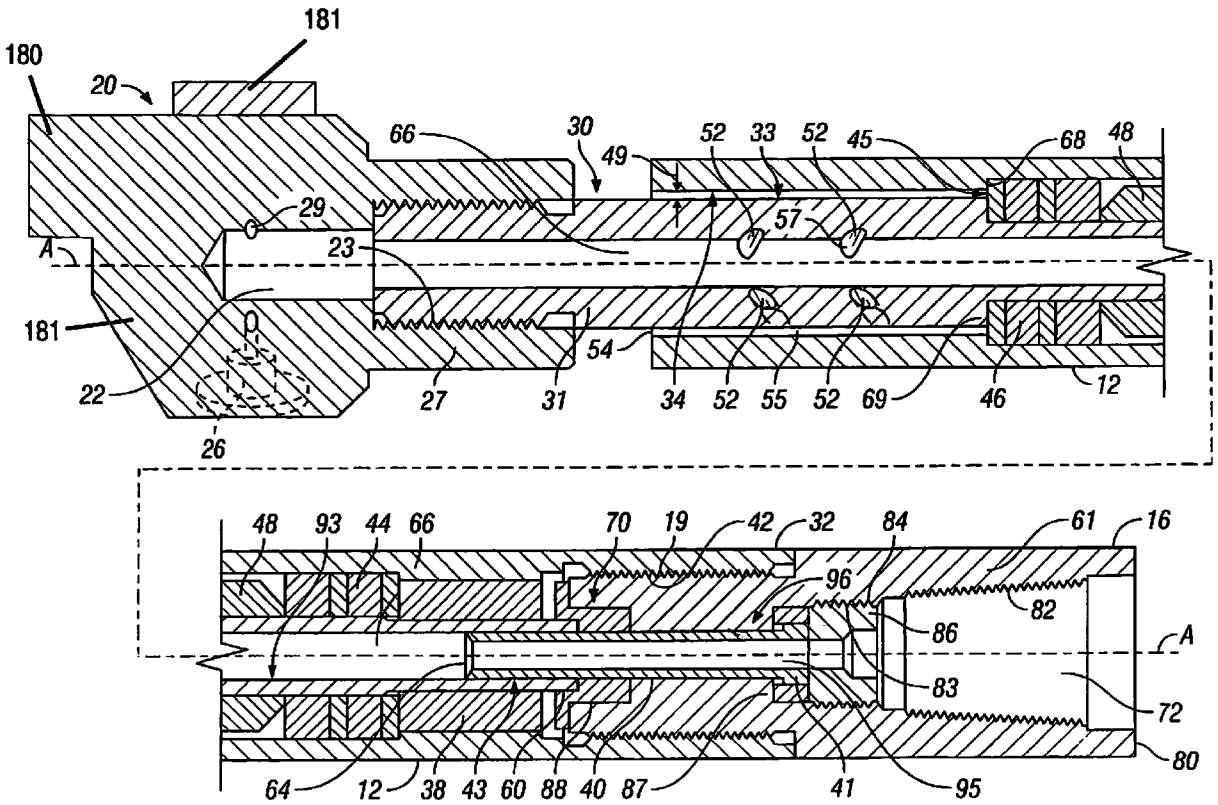
FIG. 11 is a cross-sectional view of an alternative embodiment of the motor.

A retainer nut 38 is provided on the power shaft 30 intermediate the upper radial bearing 44 and the upper end 60 of the power shaft 30. The retainer nut 38 is provided with an internal connection assembly 39 to functionally attach the retainer 38 to the corresponding connection assembly 81 provided on the power shaft 30. A purpose of the functional connection between the retainer 38 and the power shaft 30 is to retain the radial bearings 44 and 46 and the thrust bushing 48 intermediate the retainer nut 38 and a shoulder 69 on the power shaft 30 and a shoulder 68 on the control sleeve 12, as seen in FIGS. 10 and 11.

The power shaft 30, control sleeve 12, shoulder 68 of the control sleeve 12, and the end 56 of the lower radial bearing 46 define a blind annular space 55. The blind annular space 55 is intermediate the exterior surface 33 of the power shaft 30 and the inner surface 34 of the control sleeve 12. The blind annular space 55 having an upper end 45 defined by the end 56 of the lower radial bearing 46 and the shoulder 68 of the control sleeve 12. An annular opening 54 of the annular space 55 is defined intermediate the control sleeve 12 and the power shaft 30.

In an alternative embodiment, an annular seal (not shown) may be provided at the end 56 of the lower radial bearing 46 to define the upper end 45 of the annular space 55.

At least one drive nozzle 52 extends through the wall 31 of the power shaft 30. In an exemplary embodiment, at least two drive nozzles 52 are provided and are radially spaced within the wall 31 of the power shaft 30. The drive nozzles 52 are in fluid communication with the internal channel 66 of the power shaft 30.

The drive nozzles 52 are located intermediate the annular opening 54 of the annular space 55 and the upper end 45 of the annular space 55. The drive nozzles 52 allow fluid to flow from the internal channel 66 of the power shaft 30 to the annular space 55.

Figure 8A:
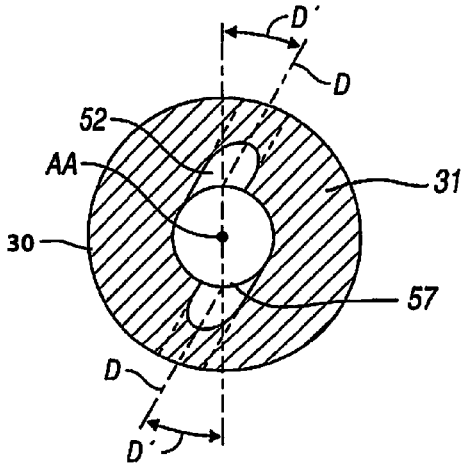
FIG. 8A is a cross-sectional view of the power shaft of an exemplary embodiment motor taken along plane 8A in FIG. 7.
Figure 8B:
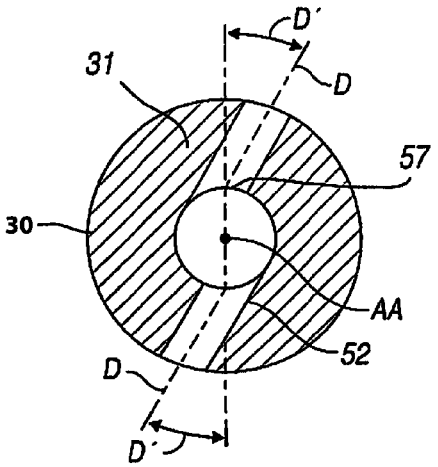
FIG. 8B is an alternative embodiment of FIG. 8A.

The drive nozzles 52 each have an axis D therethrough, as seen in FIGS. 8A and 8B. Referring to FIG. 8B, axis D of the drive nozzle 52 is angled radially to allow fluid expulsion from the nozzles 52. This fluid expulsion acting on the interior of the outer housing 25, or other area proximate the nozzle 52, provides rotational thrust in a desired direction. In addition, the radially extending angle D' of the drive nozzle 52 may be angled obliquely or aslantingly thereby expelling the fluid therefrom, in operation, at an angle further encouraging rotation of the power shaft 30 and in turn rotating the eccentric member 20.

Stated another way, the radially extending angle D' of the drive nozzle 52 may be angled with respect to a plane P passing parallel to and along the longitudinal axis AA at the interior opening 57. The radial angle D' of the drive nozzle's 52 axis D in relation to the plane P is acute. In an exemplary embodiment, the plane P intersects axis D at the interior opening 57.

In an alternative embodiment, axis D may extend backward toward the upper subassembly 16 of the motor 10. Stated differently, axis D may be oriented angularly with respect to axis AA, as depicted in FIG. 8A, wherein the angle is acute in the direction of the power shaft's 30 upper end 60 and obtuse with respect to the direction of its threaded lower connector 23. Accordingly, the drive nozzles 52 are oriented rearward in relation to the power shaft 30.

In the exemplary embodiments shown, the rotation nozzles 26 and drive nozzles 52 are depicted. In an alternative embodiment, not shown, ports, or openings, may be provided without nozzles to achieve the desired result. The principles taught in this disclosure apply with ports and/or openings used in lieu of rotation nozzles 26 and/or drive nozzles 52.

Figure 7A:
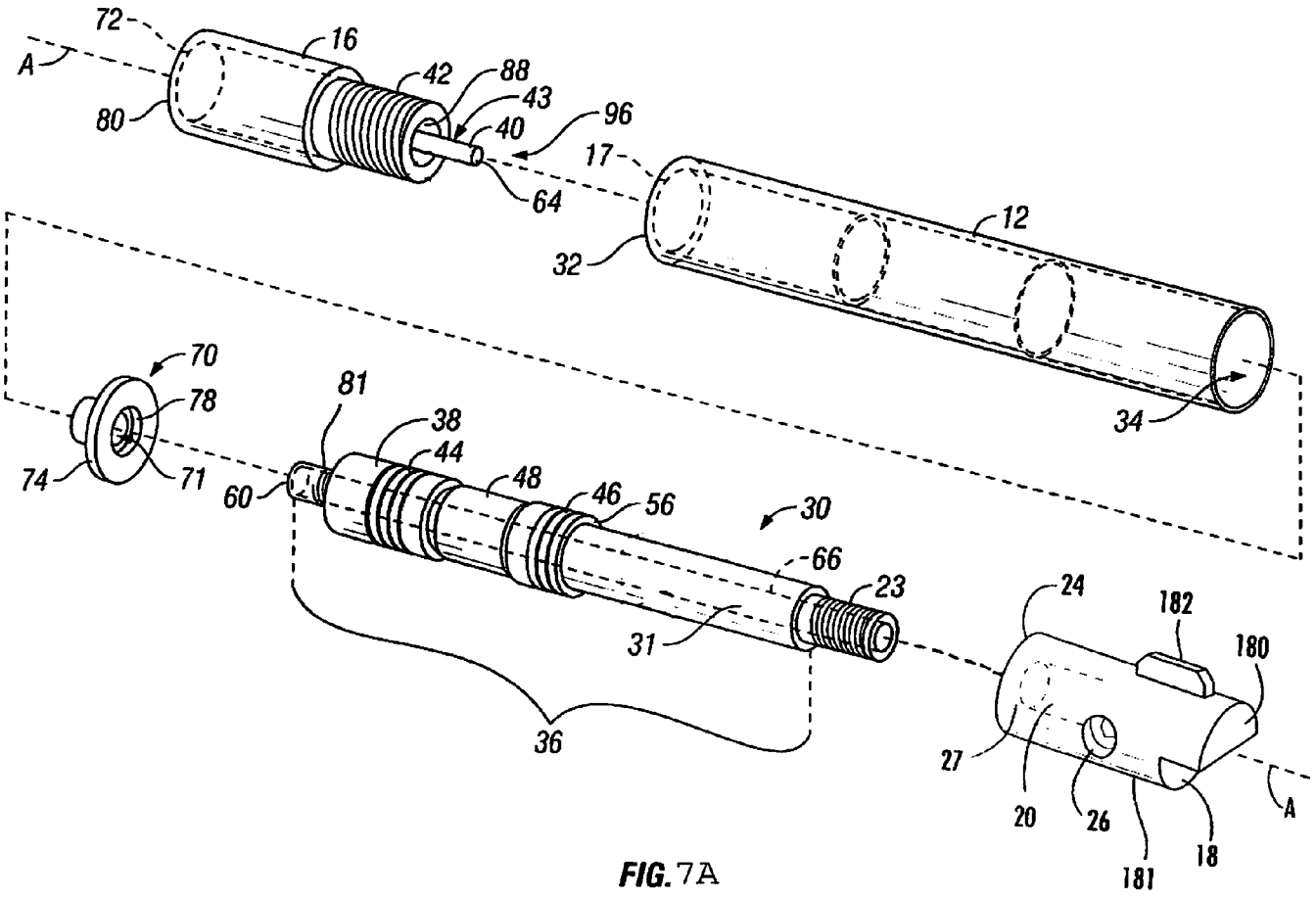
FIG. 7A is a partial exploded view of an alternative embodiment of the motor of FIG. 5.

Referring to FIG. 7A, in an alternative embodiment, power shaft 30 is not equipped with drive nozzles 52. In this embodiment, rotation nozzle 26 of the eccentric member 20 drives jet motor 10.

Referring to FIG. 10, the inner surface 34 of the control sleeve 12 is spaced from the exterior surface 33 of the power shaft 30. The resultant space therebetween defines gap 49. In operation, fluid is forced through the internal channel 66 and is expelled through at least one drive nozzle 52. Upon said expulsion the fluid impacts the inner surface 34. The radial angle D' of the drive nozzles 52 force the fluid to exit the nozzles 52 at a radial angle thereby providing, and/or enhancing the, rotational force when the fluid impacts the inner surface 34 resulting in the rotation of the power shaft 30 and, through functional coupling, the rotation of the eccentric member 20.

In an exemplary embodiment, the gap 49 is in the range of 0.0381 cm to 0.0762 cm (0.015" to 0.030") for a motor 10 having a nominal diameter in the range of 3.175 cm to 4.445 cm (1.25" to 1.75"). In an exemplary embodiment, the gap 49 is in the range of 0.508 cm to 0.635 cm (0.20" to 0.25") for a motor 10 having a nominal diameter in the range of 10.4775 cm to 12.065 cm (4.125" to 4.75"). Generally, the gap 49 is effective in a range of ratios of gap 49 to nominal diameter of the control sleeve 12 (gap:sleeve diameter) as follows: 1:125 to 1:17. Depending on various application requirements, including the fluid used, nozzle size, pressure and other factors, ratios outside the foregoing range may be provided and even preferred.

Referring to FIGS. 7 and 10, the upper subassembly 16 comprises a generally hollow cylindrical body 61 having a connecting assembly 82 for functional coupling to a drill string or tubing (not shown) at its upper end 80. In an exemplary embodiment, connecting assembly 82 of upper subassembly 16 functionally couples with lower housing connection end 196 of top sub 150. Further, the upper subassembly 16 has a connecting assembly 83 at its lower end 42 for connecting the subassembly 16 to the motor 10 via its control sleeve 12 at the control sleeve's connecting assembly 19. The upper subassembly 16 includes an interior channel 72 that is aligned with top sub 150 fluid passage 198 and axis AA.

An injection tube 96 is provided in upper subassembly 16. The injection tube 96 includes an elongated tube 40 and a tube head 41. The tube head 41 has a larger diameter than the tube 40. A tube retaining nut 86 is provided to retain the tube head 41 between the retaining nut 86 and a shoulder 87 provided in upper subassembly 16. The retaining nut 86, tube head 41 and tube 40 define a continuous tube channel 95 aligned with axis AA. The retaining nut 86 has a connecting assembly 84 for functional connection to connecting assembly 83 provided in upper subassembly 16.

In an exemplary embodiment, the injection tube 96 is retained in position by the retaining nut 86 and the shoulder 87 of upper subassembly 16. The injection tube 96 is free to rotate about axis AA independent of the rotation of the power shaft 30 and upper subassembly 16.

The upper subassembly 16 is provided with a cylindrical inset 88 at its lower end 42. A thrust bushing 70 is at least partially disposed within the cylindrical inset 88 and provides a bearing surface intermediate the upper subassembly 16 and power shaft assembly 36. The thrust bushing 70 additionally encloses and provides radial support for the tube 40.

In an exemplary embodiment, the tube 40 extends past the lower end 42 of the upper subassembly 16 and into the channel 66 of the power shaft 30.

The interior surface 71 of the thrust bushing 70 is sized and constructed to encircle the exterior surface 43 of the tube 40 but to allow rotation between the surfaces. The thrust bushing 70 further contains a flange 74 extending radially outward from the center of the bushing 70. The flange 74 is received between the lower end 42 of the upper subassembly 16 and the upper end 60 of the power shaft 30. The thrust bushing 70 includes a cylindrical inset 78 to receive a segment of the power shaft 30 at the upper end 60 of the power shaft 30. The cylindrical inset 78 may be sized and constructed to slideably receive end 60 of power shaft 30.

The diameter of the outer surface 43 of the tube 40 is preferably only slightly smaller than the diameter of the power shaft's channel 66 thereby allowing the tube 40 to be slideably received in the channel 66.

In an exemplary embodiment, the injection tube 96 is at least partially composed of a tube wall 40 having a width and design such that the wall 40 will expand slightly when an appropriate operating pressure is moved through the tube channel 95, interior to the wall 40. Such slight expansion may create a seal between the exterior surface 43 of the tube wall 40 and the interior surface 93 of the power shaft 30, wherein said interior surface 93 defines channel 66.

In an exemplary embodiment, the tube wall 40 is provided with a slight flare proximate its lower end 64 to enhance sealing of the tube wall 40 against the interior surface 93. A preferred flare angle is up to five degrees outwardly from the tube wall 40 segment that is not flared.

In summary, the power shaft assembly 36 is fixedly attached to the eccentric member 20. The power shaft assembly 36 is rotatable within the control sleeve 12. A blind annular space 55 is defined between the power shaft 30 and the control sleeve 12 for at least partial fluid expulsion.

In an alternative embodiment, the motor does not have the control sleeve 12. In this embodiment, the fluid is expelled from the drive nozzles 52 directly against the interior surface 202 of the housing 25. Alternatively, the fluid may be expelled from the drive nozzles 52 directly against the interior surface of the wellbore.

A purpose of the motor 10 is to provide a conduit for the fluid to enter the eccentric member thereby allowing rotation thereof through expulsion of fluid therethrough. A purpose of the motor 10 is to provide rotation, either alone or in addition to any rotative force produced by the eccentric member 20, to the eccentric member 20 to create the desired vibration and/or oscillations in the bottom hole assembly.

In operation, the downhole oscillator 5 is formed whereby the motor 10 is functionally coupled to the eccentric member 20. The motor 10 and the eccentric member 20 may be disposed, at least partially, within the outer housing 25. The oscillator 5 is functionally coupled to a drill string or tube by way of the top sub 150. A fluid (not shown), which may be drilling fluid or a gas, is introduced into the drill string or tube at a determined pressure. Pressure is applied to the fluid forcing the fluid through the channels 198, 72, 95, 66 and 22. The fluid is forced through the drive nozzles 52 and, if present, the rotation nozzles 26 and is expelled against at least a portion of the outer housing 25 or control sleeve 12. If no nozzles are utilized fluid will be expelled through the openings in the power shaft 30 wall 31 and, if present, the openings in the cylinder wall 27 of the eccentric member 20. The pressure from the fluid in the channels 66 and 22 is greater than the ambient downhole pressure. Differential pressure at the rotation nozzles 26 and/or the drive nozzles 52, or openings if nozzles are not utilized, create rotational torque on the eccentric member 20 and the power shaft 30.

The proximity of the inner surface 34 of the control sleeve 12 or outer housing 25 provides a surface that is stationary relative to the power shaft 30. The expansive force of the fluid escaping the drive nozzles 52 and/or rotation nozzles 26 and impinging the surface 34 of control sleeve 12 may enhance the rotational torque on the power shaft 30.

The gap 49 may be determined to provide desired reactive force of fluid expelled through the drive nozzles 52 at the inner surface 34. In addition, the force of the drilling fluid may be manipulated in order to control the thrust of the drilling fluid through the drive nozzles 52 and rotation nozzles 26, if present, against the control sleeve 12 inner surface 34 and/or the interior surface of the outer housing 25 thereby controlling the rotation of the power shaft 30 and the eccentric member 20.

As the drive nozzles 52 may be located intermediate the opening 54 of the annular space 55 and the upper end 45, fluid forced out of drive nozzles 52 may be forced out of the opening 54, thereby continually washing the annular spaces 55, 200 and preventing accumulation of debris therein.

FIG. 11 depicts an alternative exemplary embodiment wherein four drive nozzles 52 are located on the power shaft 30 in order to increase the amount of fluid expelled through the drive nozzles 52. The drive nozzles 52 are depicted as symmetrically situated opposing pairs with respect to each other. However, the drive nozzles 52 may also be situated asymmetrically or in any combination of the two.

In an exemplary embodiment, an appropriate gas, such as nitrogen, may be utilized as the fluid medium. The construction of the present invention, particularly the construction of the injection tube wall 40 with expansion capability upon application of appropriate fluid pressure in the tube channel 95 together with the fit of exterior surface 43 of the tube wall 40 and the interior surface 93 of the power shaft 30 may allow the creation of an effective seal even though the fluid is a gas.

The exemplary embodiment providing a flared lower end 64 of the tube wall 40 provides an effective seal at the interior surface 93 as internal fluid pressure is applied at the open end of the lower end 64 of the tube wall 40.

A method of use includes providing a downhole oscillator 5. The downhole oscillator 5 may comprise providing a motor 10, which may be capable of producing rotational movement, and/or one or more eccentric members 20, wherein some may be capable of producing rotational movement and wherein same may be of varying sizes and weights. This step may further include providing an outer housing 25 at least partially surrounding the motor 10 and eccentric member 10. In the exemplary embodiments shown, the outer housing 25 fully encloses the motor 10 and eccentric member 20 and connects to a top sub 150 and a lower sub 100 thereby remaining stationary in relation to the eccentric member and/or at least a portion of the motor 10. Further, the motor 10 may contain a power shaft 30 having at least one opening or drive nozzle 52 in the shaft wall 31.

Selecting an appropriate eccentric member 20 to provide the desired or requested oscillations and/or vibrations. This step may require selecting different eccentric members 20 depending on changing conditions downhole or changing requirements.

Manipulating the eccentric member 20 by adding or removing varying sizes, types, or shaped protrusions 182 to manipulate the weight and/or size of the eccentric member 20 as desired. The manipulating step may also include the utilization of different materials on the eccentric member, such as the use of cobalt for the protrusion 182 or steel or iron or some other material.

Functionally coupling the motor 10 to an eccentric member 20. The coupling step may include coupling the motor 10 via its power shaft 30 to the selected eccentric member 20. This coupling may be removable. Functionally coupling the eccentric member 20 to a drill string to produce the desired or requested oscillations (whereby when used in this specification the terms oscillations and vibrations are interchangeable).

Assembling the downhole oscillator 5 whereby desired.

Connecting the downhole oscillator 5 to the drill string, either directly or indirectly.

Lowering the eccentric member 20 and/or downhole oscillator 5 downhole. Introducing fluid to the drill string thereby powering the eccentric member 20. Running the downhole oscillator 5 to produce oscillations to the bottom hole assembly.

Removing the downhole oscillator 5 from the wellbore. Switching out the eccentric member for another or otherwise manipulating the eccentric member 5 such that a different hertz will be produced once it is lowered back into the wellbore and operated.

A method of use may also include introducing a fluid or gas, collectively referred to as a fluid, under pressure to the downhole oscillator 5. At least a portion of the fluid being introduced, under pressure, to the interior of the motor 10. This fluid being used to power the motor 10 through the drive nozzles 52, power the eccentric member 20 through the rotation nozzles 26, and/or both. The fluid may travel through the dump ports 155 of the top sub 150 and travel along the interior 202 of the housing 25 thereby bypassing the motor 10 and the eccentric member 20 and proceeding downhole for use further down the string. The fluid that is used to power the motor 10 and/or the eccentric member 20 escapes the downhole oscillator 5 and will travel down the string to be used elsewhere.

Alternatively, a method of use may include further providing a power shaft 30, the power shaft 30 having an upper end 80 and a lower end 81 and is functionally attached to an eccentric member 20 at the lower end 23. The eccentric member 20 having a cylinder wall 27 and a longitudinal axis AA, with at least one eccentric member rotation nozzle 26, having an opening axis N and an interior opening 29, in the cylinder wall 27. A method of use may also include an introducing step comprising introducing a fluid or gas under pressure to the rotatable power shaft 30 such that the fluid or gas is forced through the at least one rotation nozzle 26.

Additionally, a method of use may include a combination of the two aforementioned methods, wherein a providing step comprises providing a power shaft 30 with at least one drive nozzle 52 and an eccentric member 10 with at least one rotation nozzle 26. Method of use may also include an introducing step comprising introducing a fluid or gas under pressure to the rotatable power shaft 30 such that the fluid or gas is forced through the at least one drive nozzle 52 and the at least one rotation nozzle 26.

In the aforementioned methods, the fluid may be a gas. The gas may be nitrogen.

The downhole oscillator 5 may provide vibrations of twenty-four to thirty-five Hz within the outer diameter of at least a portion of the bottom hole assembly; though other frequencies may be produced as desired. This degree of frequency may reduce the friction of the bottom hole assembly thereby improving the string to bit weight transfer when used with coiled tubing. Further, by providing vibrations to the bottom hole assembly, the rate of penetration may be improved.

The downhole oscillator 5 may allow up to one hundred twenty gallons of fluid per minute to flow therethrough.

The downhole oscillator 5 may be used with coiled tubing.

The depicted exemplary embodiments may be altered in a number of ways while retaining the inventive aspect, including ways not specifically disclosed herein.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features and characteristics described in conjunction with a particular aspect, embodiment or example of the invention are to be understood to be applicable to any other aspect, embodiment or example described herein unless incompatible therewith.

All of the features disclosed in this specification (including any accompanying claims, abstract and drawings), and/or all of the steps of any method or process so disclosed, may be combined in any combination, except combinations where at least some of such features and/or steps are mutually exclusive. In other words, the method steps have not been provided for in any particular sequential order and may be rearranged as needed or desired, with some steps repeated sequentially or at other times, during use.

Each feature disclosed in this specification (including any accompanying claims, abstract and drawings), may be replaced by alternative features serving the same, equivalent, or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

What is claimed is:

1. A downhole oscillating tool, comprising:

a generally cylindrical eccentric member, comprising a closed end and an opposite open connection end, and comprising an outer diameter;

said eccentric member functionally coupled to a drill string at its open connection end;

said eccentric member having an enlarged portion extending axially from said closed end of said eccentric member, wherein said enlarged portion has a smaller surface area in relation to the remaining portion of said eccentric member;

a motor, wherein said motor is operatively connected to said eccentric member; and wherein said eccentric member and said motor are at least partially contained within a housing.

2. The downhole oscillating tool of claim 1, further comprising:

a protrusion extending from said enlarged portion.

3. The downhole oscillating tool of claim 1, further comprising:

said motor having a motor internal channel extending at least partially therethrough, wherein said motor internal channel is in fluid communication with a fluid source;

said motor is connected to said eccentric member;

said eccentric member having an internal channel extending at least partially therethrough wherein said eccentric member internal channel is in fluid communication with said fluid source; and at least one rotation port extending from said eccentric member internal channel to the exterior of said eccentric.

4. The downhole oscillating tool of claim 3, wherein said at least one rotation port extends radially in an oblique manner in relation to the longitudinal axis of said eccentric member.

5. The downhole oscillating tool of claim 4, wherein said at least one rotation port is angled backward toward said connecting end of said eccentric member.

6. The downhole oscillating tool of claim 3, further comprising:

said motor internal channel is in fluid communication with said eccentric member internal channel and said fluid source;

said motor functionally connected to said eccentric member at its connecting end and proximate said eccentric member internal channel thereby allowing fluid to flow from said motor internal channel to said eccentric member internal channel;

said motor having at least one drive port extending from said motor internal channel to the exterior of said motor, wherein said at least one drive port extends through at least a portion of the wall of said motor; and wherein said eccentric member and said motor are at least partially contained within a housing, wherein said housing is functionally coupled to a drill string.

7. The downhole oscillating tool of claim 6, wherein said housing fully contains said eccentric member and said motor therein and wherein said at least one rotation port and said at least one drive port are in fluid communication with at least a portion of the interior of said housing.

8. A downhole oscillating tool of claim 7, wherein said at least one drive port extends radially in an oblique manner in relation to the longitudinal axis of said motor, and wherein said at least one drive port is angled backward in a direction away from said eccentric member's connecting end.

9. The downhole oscillating tool of claim 1, wherein said eccentric member and said motor are fully contained within said housing.

10. A downhole oscillating tool, comprising:

an eccentric member;

wherein said eccentric member is asymmetrical;

a protrusion functionally attached to at least a portion of said asymmetrical eccentric member;

a motor functionally connected to said eccentric member wherein said eccentric member and said motor are at least partially contained within a housing, wherein said housing is functionally coupled to a drill string;

wherein said housing fully contains said eccentric member and said motor therein;

said eccentric member having an eccentric member internal channel extending at least partially therethrough wherein said eccentric member internal channel is in fluid communication with a fluid source;

at least one rotation port extending from said eccentric member internal channel to the exterior of said eccentric member;

said motor having a motor internal channel extending at least partially therethrough, wherein said motor internal channel is in fluid communication with said eccentric member internal channel and said fluid source;

said motor functionally connected to said eccentric member proximate said eccentric member internal channel thereby allowing fluid to flow from said motor internal channel to said eccentric member internal channel;

a top sub having a top sub internal channel extending at least partially therethrough, wherein said top sub internal channel is in fluid communication with a fluid source, and said top sub having a lower housing connection end and a lower motor connection end proximate thereto;

at least one dump port disposed intermediate said lower housing connection end and said lower motor connection end;

said top sub functionally connected to said housing at said lower housing connection end distal said eccentric member and said top sub functionally connected to said motor at said lower motor connection end distal said eccentric member;

a housing annulus being defined as the space between the exterior of said motor and the interior of said housing proximate said motor exterior, wherein said dump ports are in fluid communication with said annulus; and wherein said top sub internal channel is in fluid communication with said motor internal channel.

11. The downhole oscillating tool of claim 10, wherein:

said motor further comprises:

a control sleeve;

a power shaft;

said power shaft at least partially surrounded by said control sleeve;

said power shaft rotatable in relation to said control sleeve;

said power shaft having a shaft wall;

said power shaft having an interior power shaft channel;

at least one opening provided in said shaft wall;

said at least one opening in fluid communication with said shaft channel;

said at least one opening in said shaft wall having an interior opening and an opening axis;

said power shaft having a central longitudinal shaft axis and an upper end and a lower end; and said opening axis of said at least one opening in said shaft wall radially oriented wherein said opening axis is positioned in an obtusely extending manner and wherein said opening axis is also angled backward in the direction of said upper end of said power shaft.

12. The downhole oscillating tool of claim 11, wherein said protrusion includes cobalt.

13. The downhole oscillating tool of claim 10, wherein the eccentric member is asymmetrical as between a portion of the eccentric member proximate its lower end in relation to a portion of the eccentric member proximate its upper end.

14. The downhole oscillating tool of claim 10, wherein said eccentric member and said motor are fully contained with said housing.

15. A downhole oscillating tool, comprising;

an eccentric member;

wherein said eccentric member is asymmetrical;

said eccentric member having a portion containing a larger surface area in relation to the remaining surface of said eccentric member;

said larger surface area having a protrusion attached thereto;

a motor having a motor internal channel extending at least partially therethrough, wherein said motor internal channel is in fluid communication with a fluid source;

said motor functionally connected to said eccentric member; and said motor having at least one drive port extending from said motor internal channel to the exterior of said motor, wherein said at least one drive port extends through at least a portion of the wall of said motor.

16. The downhole oscillating tool of claim 15, wherein said at least one drive port extends radially in an oblique manner in relation to the longitudinal axis of said motor, and wherein said at least one drive port is angled backward in a direction away from said eccentric member's connecting end.

17. The downhole oscillating tool of claim 16, further comprising:

a housing, wherein said housing fully contains said eccentric member and said motor therein;

a top sub having a top sub internal channel extending at least partially therethrough, wherein said top sub internal channel is in fluid communication with a fluid source, and said top sub having a lower housing connection end and a lower motor connection end proximate thereto;

at least one dump port disposed intermediate said lower housing connection end and said lower motor connection end;

said top sub functionally connected to said housing at said lower housing connection end distal said eccentric member and said top sub functionally connected to said motor at said lower motor connection end distal said eccentric member;

a housing annulus being defined as the space between the exterior of said motor and the interior of said housing proximate said motor exterior, wherein said dump ports are in fluid communication with said annulus;

wherein said top sub internal channel is in fluid communication with said motor internal channel;

wherein said eccentric member having an eccentric member internal channel extending at least partially therethrough wherein said eccentric member internal channel is in fluid communication with a fluid source;

at least one rotation port extending from said eccentric member internal channel to the exterior of said eccentric member, wherein said at least one rotation port extends through at least a portion of said eccentric member; and wherein said at least one rotation port extends radially in an oblique manner in relation to the longitudinal axis of said eccentric member and wherein said at least one rotation port is angled backward toward said connecting end of said eccentric member.

18. A method of using a downhole oscillating tool, comprising:

providing a downhole oscillator comprising a motor coupled to one or more eccentric members, wherein said motor and said eccentric member are at least partially contained within a housing;

functionally coupling the downhole oscillator to a drill string to produce a desired oscillation;

lowering said downhole oscillator into a wellbore;

operating said downhole oscillator;

removing the downhole oscillator from the wellbore;

manipulating the eccentric member by adding or removing various sizes, types, or shaped protrusions to manipulate the weight and/or size of the eccentric member, wherein the manipulating step may include selecting an appropriate eccentric member; and reinserting the downhole oscillator into the wellbore and operating the downhole oscillator.

* * * * *